US009881462B2

(12) United States Patent
McTernan et al.

(10) Patent No.: US 9,881,462 B2
(45) Date of Patent: Jan. 30, 2018

(54) SYSTEM AND METHOD FOR CREATING ELECTRONIC MULTIPLAYER GAME TOURNAMENTS

(71) Applicant: Megatouch, LLC, Bristol, PA (US)

(72) Inventors: Brennan McTernan, Bristol, PA (US); William L. Layne, Harleysville, PA (US); Greg Nyce, Warrington, PA (US); Malcolm J. Harwood, Bristol, PA (US); Samir Tamri, Bouskoura (MA)

(73) Assignee: AMI ENTERTAINMENT NETWORK, LLC, Trevose, PA (US)

( * ) Notice: Subject to any disclaimer, the term of this patent is extended or adjusted under 35 U.S.C. 154(b) by 0 days.

(21) Appl. No.: 15/211,253

(22) Filed: Jul. 15, 2016

(65) Prior Publication Data

US 2017/0076552 A1 Mar. 16, 2017

Related U.S. Application Data

(60) Provisional application No. 62/193,936, filed on Jul. 17, 2015.

(51) Int. Cl.
*A63F 9/24* (2006.01)
*G07F 17/32* (2006.01)

(52) U.S. Cl.
CPC ..... *G07F 17/3276* (2013.01); *G07F 17/3293* (2013.01)

(58) Field of Classification Search
None
See application file for complete search history.

(56) References Cited

U.S. PATENT DOCUMENTS 4,582,324 A * 4/1986 Koza ..... A63F 13/12 463/16
4,652,998 A * 3/1987 Koza ..... G06Q 50/34 273/274
4,856,787 A 8/1989 Itkis
5,575,717 A 11/1996 Houriet, Jr. et al.
5,743,799 A 4/1998 Houriet, Jr. et al.
6,030,288 A * 2/2000 Davis ..... G06Q 40/025 463/29
7,857,693 B1 * 12/2010 Johnson ..... G07F 17/32 463/13

(Continued)

*Primary Examiner* — Paul A D'Agostino
(74) *Attorney, Agent, or Firm* — Panitch Schwarze Belisario & Nadel LLP

(57) ABSTRACT

Systems and methods for creating a plurality of seeds for a multiplayer tournament of an electronic game are disclosed. The system includes a server including a seed generator module, a seed sorter module, and a seed selection module. The seed generator module randomly generates the plurality of seeds. Each of the plurality of corresponds to a unique shuffle of cards of a game of the multiplayer tournament. The seed sorter module rates each of the plurality of seeds, and then sorts the plurality of rated seeds in accordance with one or more business goals. A seed selection module is configured to receive a player identifier and a tournament play count associated with a first player of the multiplayer tournament. The seed selection module is further configured to identify a rated seed for the first player in accordance with the player identifier and the tournament play count.

1 Claim, 4 Drawing Sheets

(56) References Cited

U.S. PATENT DOCUMENTS

| | | | | |
|---|---|---|---|---|
| 2007/0288243 | A1* | 12/2007 | Takahashi | A63F 13/10 704/276 |
| 2008/0076527 | A1* | 3/2008 | Low | G07F 17/32 463/25 |
| 2010/0190541 | A1* | 7/2010 | Lazar | A63F 3/08 463/17 |

* cited by examiner

SYSTEM AND METHOD FOR CREATING ELECTRONIC MULTIPLAYER GAME TOURNAMENTS

CROSS-REFERENCE TO RELATED APPLICATIONS

This application claims the benefit of U.S. Provisional Patent Application No. 62/193,936, filed on Jul. 17, 2015, entitled "System and Method for Creating Electronic Multiplayer Game Tournaments," currently pending, the entire contents of which are incorporated by reference herein.

BACKGROUND OF THE INVENTION

Embodiments of the present invention relate to electronic game tournaments, and in particular, to creating online multiplayer game tournaments based on artificial intelligence.

Amusement devices having electronic games such as blackjack and poker variation card games for computers and touch screens or other types of amusement devices are generally well known in the art. Amusement devices, such as game machines, which allow a user to select games from a video display are well known in the art such as those disclosed in U.S. Pat. No. 4,856,787 ("Itkis"); U.S. Pat. No. 5,575,717 ("Houriet, Jr., et al."); U.S. Pat. No. 5,743,799 ("Houriet, Jr., et al.") (the entire contents of all of which are incorporated by reference herein), each of which shows a touch screen for making a game selection from a menu of games. Such game machines or amusement devices typically operate upon input of currency (i.e., coin, token, paper money, credit/debit cards or the like) and are installed in locations such as bars, restaurants, airports, shopping malls, video arcades, casinos or the like. The game choices may include card games, sports games, games of skill, games of chance, action games, trivia games or the like. Such games may also operate on mobile devices.

A popular type of gaming is tournament play, where instead of playing against a computer program, two or more players compete against each other over a predetermined amount of time (e.g., one month, one week, or the like). The tournaments typically operate with a predetermined prize fund and prize award structure. Thus, such multiplayer tournaments offer players the opportunity to play against each other for increased prizes until the tournament ends.

These tournament games may oftentimes require a player to strategize in order to achieve higher scores, and potentially, win a prize. However, some regulatory agencies (national, state or local) have "gaming" regulations which require that electronic games which award prizes be based on some element of skill. Since most electronic games, such as card games, have an apparent "random deal," they are generally categorized as games of chance.

The definition of chance varies among municipalities. For example, some states consider a game to be a game of chance if a "preponderance of skill" does not contribute to winning. For a majority of municipalities, a game having a preponderance of skill is a game in which a player who is considered highly skilled will win over an average player at least 75.1% of the time.

In some municipalities, chance is determined by an existence of a "material element". A material element exists if there is an element of game play that is material to the success of the game that is driven by chance. An example of a game that has a material element is Backgammon. In Backgammon, a roll of the dice is a material part of the game, and the player cannot control its outcome. Accordingly, in municipalities that use the "material element" test to determine if a game is a game of chance, Backgammon would be considered a game of chance because of the material element of the die roll.

Another material element is a lack of equivalent fairness. In a game with equivalent fairness, each player has an equal opportunity to win the game. For example, card games are oftentimes based on a shuffling of cards. The shuffling of cards is usually based on a random number seed. Each seed corresponds to a uniquely shuffled deck of cards. Some seeds correspond to deck shuffles resulting in easier game play, and potentially higher scores than other seeds. Therefore, it is possible for one player to receive, for example, more difficult seeds of game play than another player competing in the same tournament. Consequently, the game would lack equivalent fairness.

It is desirable to create a multiplayer tournament of an electronic game that is at least partially based upon player skill, by at least having equivalent fairness so as to comply with gaming regulations.

BRIEF SUMMARY OF THE INVENTION

Systems and methods for creating a plurality of seeds for a multiplayer tournament of an electronic game are disclosed. The system includes one or more amusement devices and a server including a seed generator module, a seed sorter module, and a seed selection module. The seed generator module is configured to randomly generate the plurality of seeds. Each of the plurality of seeds corresponds to a unique shuffle of cards of a game of the multiplayer tournament. The seed sorter module is configured to rate each of the plurality of seeds, and sort the plurality of rated seeds in accordance with one or more business goals. The seed selection module is configured to receive a player identifier and a tournament play count associated with a player of the multiplayer tournament, the player being associated with one of the one or more amusement devices. The seed selection module is further configured to identify a rated seed for the player in accordance with the player identifier and the tournament play count, and present the player with a game using the identified seed.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
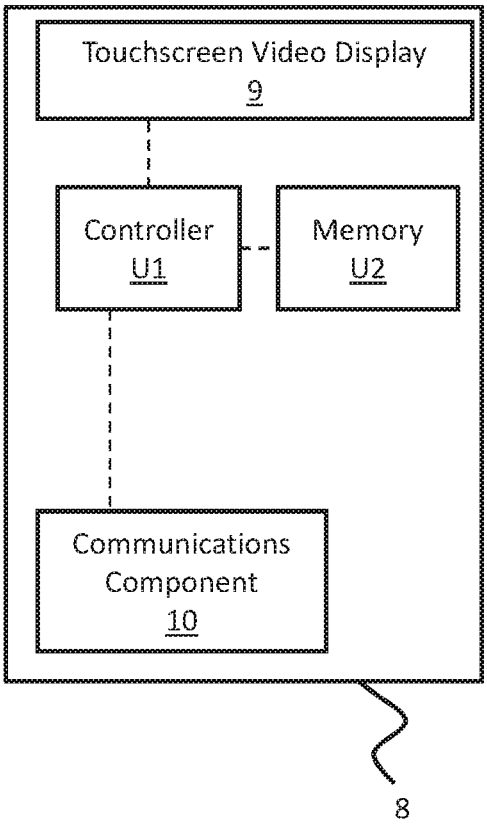
FIG. 1 is a schematic diagram of an amusement device which can run electronic tournament games in accordance with an embodiment of the present invention.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center or orientation of the amusement device, and related parts thereof. The terminology includes the above-listed words, derivatives thereof and words of similar import.

FIG. 1 depicts an amusement device 8 that runs an electronic game. The amusement device 8 includes a controller U1 and a memory U2. The amusement device 8 further includes a video display 9 which is operatively connected to the amusement device controller U1. Preferably, the video display 9 is a touchscreen video display configured to accept touch input.

The amusement device 8 may be controlled by the controller U1, the memory U2 and a touchscreen video display driver (not shown). For purposes of simplicity, the invention will be described with respect to the amusement device 8 throughout the remainder of the description, but it should be noted that the present invention could be implemented with any variety of amusement devices 8 without departing from the spirit of the invention. For example, the amusement devices 8 may refer to, without limitation, one or more personal computers, laptop computers, personal media devices, display devices, video gaming systems, gaming consoles, cameras, video cameras, MP3 players, mobile devices, wearable devices, wearable devices (e.g., iWatch by Apple, Inc.), mobile telephones, cellular telephones, GPS navigation devices, smartphones, tablet computers, portable video players, satellite media players, satellite telephones, wireless communications devices, or personal digital assistants (PDA).

The memory U2 preferably stores a plurality of electronic games and a system control program. The controller U1 is operatively coupled to the memory U2, the input device and the display 9 (i.e., the touchscreen display 9). The controller U1 controls the touchscreen display 9 based upon the system control program retrieved from the memory U2 and based upon inputs from the input device, which, in this case, is the touchscreen display 9. The memory U2 can be any known or suitable memory device such as random access memory (RAM), read only memory (ROM), flash RAM, hard disk, optical disk, or the like. As used herein, the system control program refers to all of the software functions outside of the game or music files including an operating system, display control, input control, sound drivers and the like. Other input devices which may be connected to the amusement devices 8 include a pushbutton(s), a track-ball or touchpad, a mouse, a joy-stick, a foot-pedal, a voice recognition system, a keypad or keyboard and the like. But, preferably, the input device is the touchscreen display 9.

Figure 2:
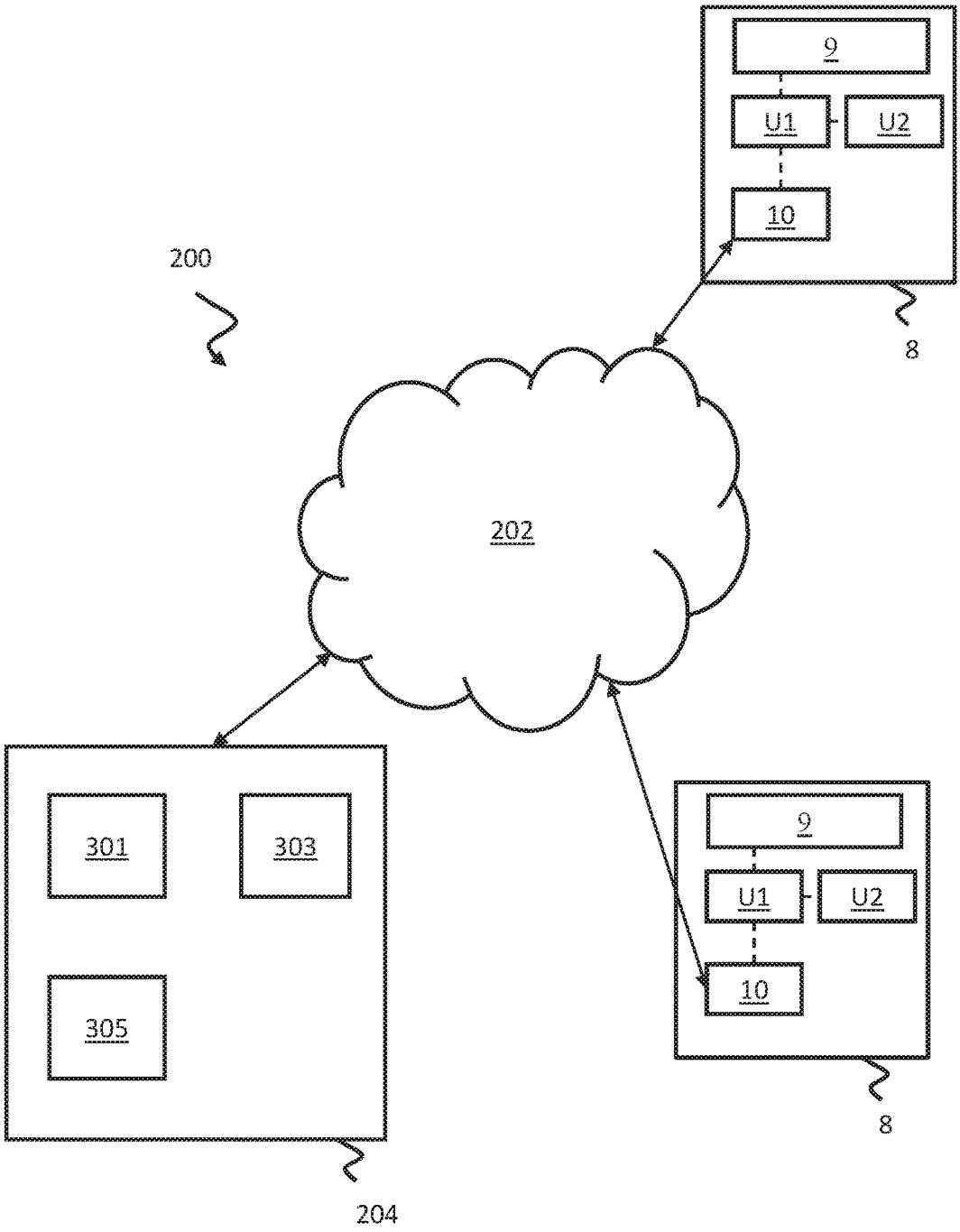
FIG. 2 is a schematic diagram of a system of amusement devices configured to play created electronic tournament games over a network.

The amusement device 8 may optionally include a communication interface 10 to connect to other amusement devices 8 to permit tournament play and/or remote accounting, remote prize awarding and the like. For example, as shown in FIG. 2, according to embodiments of the present invention, a system 200 includes a communication network 202 which operatively couples various amusement devices 8 and a remote server 204. According to this embodiment, the remote server 204 may include a memory (not shown) storing one or more electronic games, artificial intelligence, and other components necessary for tournament game play. For example, the remote server may include an AI seed generator module 301, a business based seed sorter module 303, and a seed selection module 305.

The communication network 202 may include any suitable circuitry, device, system, or combination of these (e.g., a wireless or hardline communications infrastructure including towers and communications servers, an IP network, and the like) operative to create the communications network 202. The communication network 202 can provide for communications in accordance with any wired or wireless communication standard. For example, the communication network 202 can provide for communications in accordance with second-generation (2G) wireless communication protocols IS-136 (time division multiple access (TDMA)), GSM (global system for mobile communication), IS-95 (code division multiple access (CDMA)), third-generation (3G) wireless communication protocols, such as Universal Mobile Telecommunications System (UMTS), CDMA2000, wideband CDMA (WCDMA) and time division-synchronous CDMA (TD-SCDMA), 3.9 generation (3.9G) wireless communication protocols, such as Evolved Universal Terrestrial Radio Access Network (E-UTRAN), with fourth-generation (4G) wireless communication protocols, international mobile telecommunications advanced (IMT-Advanced) protocols, Long Term Evolution (LTE) protocols including LTE-advanced, or the like.

Further, the communication network 202 may be configured to provide for communications in accordance with techniques such as, for example, radio frequency (RF), infrared, or any of a number of different wireless networking techniques, including wireless local area network (WLAN) techniques such as IEEE 802.11 (e.g., 802.11a, 802.11b, 802.11g, 802.11n, etc.), WLAN protocols, world interoperability for microwave access (WiMAX) techniques such as IEEE 802.16, and/or wireless Personal Area Network (WPAN) techniques such as IEEE 802.15, BlueTooth™, ultra wideband (UWB) and/or the like.

Disclosed embodiments of the present invention are directed to the creation of online multiplayer tournament games, where instead of playing against a computer program, two or more players compete against each other over a predetermined amount of time (e.g., one month, one week, or the like). The tournaments operate with a predetermined prize fund and prize award structure. Thus, such multiplayer tournaments offer players the opportunity to play against each other for increased prizes until the tournament ends. A tournament may include play of only one type of electronic game (e.g., TRI TOWERS), or more than one type of electronic game (e.g., TRI TOWERS, CARD BANDITS, and the like). Preferably, a player's overall tournament score consists of the sum of the player's top five scores of any combination of types of electronic games, over the predetermined amount of time.

Each play of a game may be based on certain circumstances, such as a randomized arrangement of game pieces. In a card game, for example, the circumstances may include a randomized shuffle of the cards. As such, each play of a card game may require a shuffling of cards based on a random number seed. Each seed corresponds to a uniquely shuffled deck of cards. Artificial intelligence ("AI") in a control program of the amusement device 8, or server 204, for example, may be used to generate and select particular seeds for tournament game play.

Figure 3:
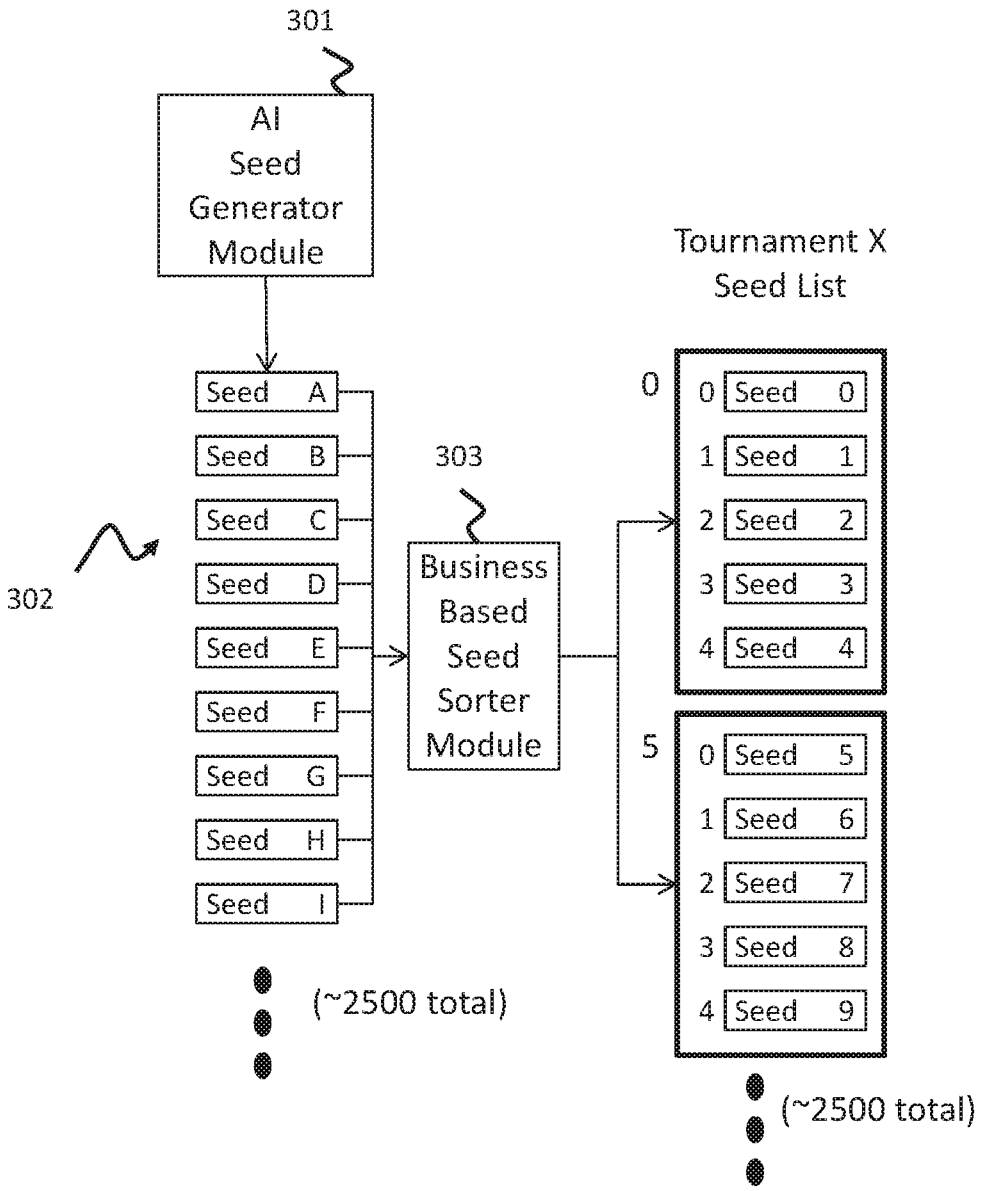
FIG. 3 is a diagram illustrating seed generation according to an embodiment of the present invention.

FIG. 3 is a diagram illustrating the generation of seeds according to an embodiment of the present invention. The seed generator module 301 is configured to generate a list of seeds 302, preferably approximately 2500, however any number of seeds may be generated in keeping with the invention. The generated list of seeds 302 is input into a business based seed sorter module 303 that rates each of the seeds. For example, the business seed sorter module 303 may use AI to automatically simulate and rate each of the generated seeds 302. Each of the generated seeds can be rated according to one or more attributes including, but not limited to, the lowest possible score found with the particular seed, the highest possible score found with the particular seed, and the average score found through simulated game plays with the particular seed.

The business based seed sorter module 303 preferably creates an ordered list of the rated seeds according to the business goals of the game. Business goals may include, but are not limited to, fair game play, player experience, and the like. For example, presenting new, or otherwise less skilled players, with lower rated seeds (e.g., seeds that have comparatively higher possible scores), prevents the less skilled players from becoming frustrated with the difficulty of the game. As a result, the player experience of new, or otherwise less skilled players, is improved. To keep players' interest as they become more experienced, the AI may provide players with more difficult seeds (e.g., seeds that have a lower possible score). As such, more experienced players are presented with bigger challenges by being given more difficult seeds with which to play. Even still, some generated seeds may correspond to card shuffles that may have highly undesirable results, being deemed impossible to solve. Through rating the seeds, the AI of the system 200 can remove these undesirable seeds from the list.

Fair game play is achieved by assigning the same seeds to each player competing in the tournament. As a result, each player is presented with the same level of difficulty resulting in equivalently fair game play. One concern, however, with having the same list of seeds for each player is that players can learn, or otherwise get an idea of circumstances of a particular play of a game prior to his or her actual turn, giving a player going second, third, and so on, an advantage over previous players of the same tournament. For example, in certain electronic card games, players may be awarded higher scores for faster game play, or for quickly completing a particular round, or play of the game. By being able to see the particular shuffle of the cards prior to his or her game actually starting, the player may be able to more quickly ascertain the more desirable moves resulting in a higher score.

To decrease, or otherwise remove, such an advantage, the business based seed sorter module 303 groups the seeds together, preferably in groups of 5, and varies the order in which each player sees each seed. For example, one player may play in a tournament with the seeds in the order, such as: Seed 0, Seed 1, Seed 2, Seed 3, Seed 4. Another player in the same tournament may be presented with games with the seeds in a different order, such as: Seed 1, Seed 0, Seed 4, Seed 3, Seed 2. With 5 seeds, there is a possibility of 5! or 120 different permutations of seed orders for game play. These 120 permutations are placed into a sequence permutation list 307. Consequently, with this many combinations of seed orders, it is more difficult for any player to gain an advantage by looking at the shuffle of any other player, prior to his or her own play of the game.

Figure 4:
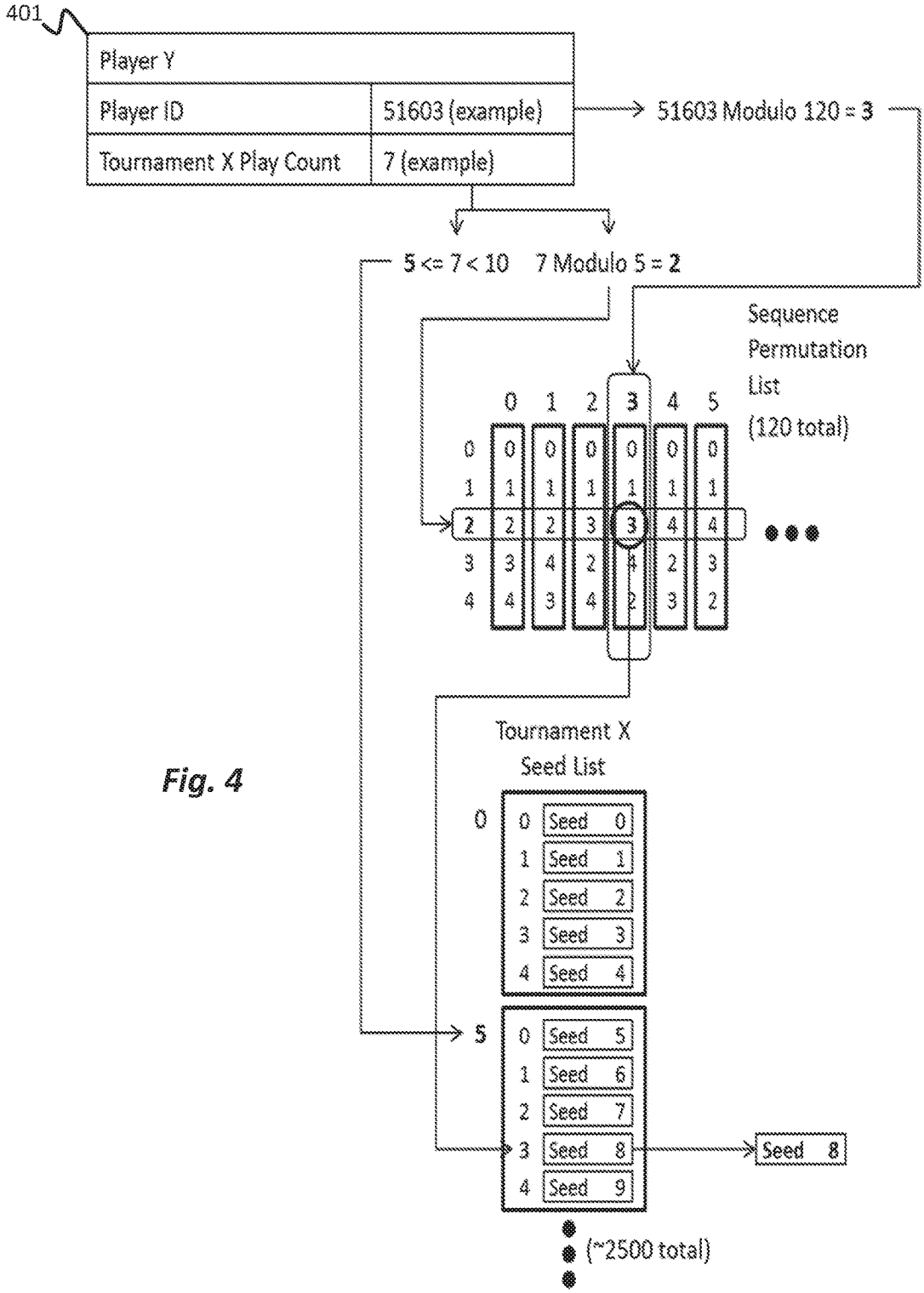
FIG. 4 is a diagram illustrating seed selection for a particular player according to an embodiment of the present invention.

FIG. 4 is a diagram illustrating seed selection (which may be performed, for example, by the seed selection module 305) of a tournament for a particular player according to an embodiment of the present invention. Each player has a record 401 that stores a unique Player ID and the number of game plays ("Play Count") for a particular tournament. The record can be generated upon a player's registration to play a particular game.

As shown in the example of FIG. 4, Player Y has a player ID "51603" and has a tournament play count of "7" for tournament X. In other words, Player Y has played 6 previous tournament games and is ready for game number 7 of tournament X.

The seeds are selected for a particular player of the tournament based on the player's ID and play count. Based on the Player's ID, the system 200 creates an index into the sequence permutation list. The system creates the index by calculating the modulo of the Player's ID and number of permutations of the sequence permutation list, otherwise expressed as (Player's ID) modulo 120, which is equivalent to the remainder of the Player's ID divided by 120. For example, as shown in FIG. 4, Player Y's ID is 51603. As such, the seed selection module 305 calculates the modulo of 51603 and 120 or, 51603 mod 120, which is equal to 3. The seed selection module 305 is configured to use the number "3" to be the sequence index into the sequence permutation list. As shown in FIG. 4, Sequence 3 uses the indices in the order: 0, 1, 3, 4, 2.

The seed selection module 305 uses the player's play count to access the seed to be used for each game of the tournament. More specifically, the seed selection module 305 operates on the play count for two parameters, a desired seed list block of the tournament X seed list and the permutation element index. The seed list block refers to the block of 5 games in which the player is currently playing. In the example illustrated in FIG. 4, the tournament play count is "7". Because 7 is greater than or equal to 5, but less than 10, game 7 corresponds to a game in the second block of the seed list blocks of the tournament X seed list corresponding to Seeds 5-9.

In conjunction with the sequence index, the permutation element index is used to select the specific play number within the desired block that should be used for the current play count. By taking the modulo of the play count and the number of seeds per block (e.g., 5), the seed selection module 305 determines the permutation element index. In this example, the seed selection module 305 takes the play count "7" and the number of seeds per block "5" (i.e., 7 mod 5), resulting in the permutation element index of "2". At the intersection of the sequence index and the permutation element index 2, the seed selection module 305 determines a specific play number within the selected block. Therefore, according to the example in FIG. 4, for Player Y, game 7 of Tournament X will be play 3 of the second block of five games, which is Seed 8.

Such a technique results in unique combinations of seeds for different players of the same tournament. For example, for the same tournament X, seeding for player Z having an ID can be calculated. As shown in the below chart, player Z will play the same seeds (or shuffled games) as player Y, albeit in a different order. As such, equivalent fairness is achieved without giving one of the competing players an unfair advantage.

| | Player Y (Permutation Index list is 0, 1, 3, 4, 2) | Player Z(Permutation Index list is 0, 1, 4, 3, 2) |
|---|---|---|
| Game 0 | (0 <= 0 < 5, 0 Mod 5 = 0, index 0 is 0) Seed 0 | (0 <= 0 < 5, 0 Mod 5 = 0, index 0 is 0) Seed 0 |

-continued

| | Player Y (Permutation Index list is 0, 1, 3, 4, 2) | Player Z(Permutation Index list is 0, 1, 4, 3, 2) |
|---|---|---|
| Game 1 | (0 <= 1 < 5, 1 Mod 5 = 1, index 1 is 1) Seed 1 | (0 <= 1 < 5, 1 Mod 5 = 1, index 1 is 1) Seed 1 |
| Game 2 | (0 <= 2 < 5, 2 mod 5 = 2, index 2 is 3) Seed 3 | (0 <= 2 < 5, 2 mod 5 = 2, index 2 is 4) Seed 4 |
| Game 3 | (0 <= 3 < 5, 3 mod 5 = 3, index 3 is 4) Seed 4 | (0 <= 3 < 5, 3 mod 5 = 3, index 3 is 3) Seed 3 |
| Game 4 | (0 <= 4 < 5, 4 mod 5 = 4, index 4 is 2) Seed 2 | (0 <= 4 < 5, 4 mod 5 = 4, index 4 is 2) Seed 2 |
| Game 5 | (5 <= 5 < 10, 5 mod 5 = 0, index 0 is 0) Seed 5 | (5 <= 5 < 10, 5 mod 5 = 0, index 0 is 0) Seed 5 |
| Game 6 | (5 <= 6 < 10, 6 mod 5 = 1, index 1 is 1) Seed 6 | (5 <= 6 < 10, 6 mod 5 = 1, index 1 is 1) Seed 6 |
| Game 7 | (5 <= 7 < 10, 7 mod 5 = 2, index 2 is 3) Seed 8 | (5 <= 7 < 10, 7 mod 5 = 2, index 2 is 4) Seed 9 |
| Game 8 | (5 <= 8 < 10, 8 mod 5 = 3, index 3 is 4) Seed 9 | (5 <= 8 < 10, 8 mod 5 = 3, index 3 is 3) Seed 8 |

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

We claim:

1. A method for creating a plurality of seeds for a multiplayer tournament, the method comprising:

randomly generating the plurality of seeds, each of the plurality of seeds corresponding to a unique shuffle of cards of a game of the multiplayer tournament;

rating each of the generated plurality of seeds;

sorting the rated seeds into an ordered list in accordance with one or more business goals;

receiving a player identifier and a tournament play count associated with a first player of the multiplayer tournament;

identifying a rated seed for the first player in accordance with the player identifier and the tournament play count; and presenting the first player with a game using the identified seed.

* * * * *